US005385818A

United States Patent [19]

Maskasky

[11] Patent Number: 5,385,818

[45] Date of Patent: Jan. 31, 1995

[54] PROCESS FOR THE PREPARATION OF SILVER HALIDE EMULSIONS AND PHOTOGRAPHIC ELEMENTS CONTAINING HOLLOW SILVER HALIDE GRAINS

[75] Inventor: Joe E. Maskasky, Rochester, N.Y.

[73] Assignee: Eastman Kodak Company, Rochester, N.Y.

[21] Appl. No.: 202,320

[22] Filed: Feb. 25, 1994

[51] Int. Cl.[6] ..... G03C 1/035

[52] U.S. Cl. ..... 430/567; 430/569

[58] Field of Search ..... 430/567, 569

[56] References Cited

U.S. PATENT DOCUMENTS

| | | | |
|---|---|---|---|
| 4,184,878 | 1/1980 | Maternaghan | 430/567 |
| 4,419,442 | 12/1983 | Falxa et al. | 430/567 |
| 4,439,520 | 3/1984 | Kofron et al. | 430/434 |
| 4,643,966 | 2/1987 | Maskasky | 430/567 |
| 4,710,455 | 12/1987 | Iguchi et al. | 430/567 |
| 4,916,052 | 4/1990 | Irving et al. | 430/567 |
| 4,952,489 | 8/1990 | Amicucci | 430/567 |
| 5,045,443 | 9/1991 | Urabe | 430/567 |
| 5,264,337 | 11/1993 | Maskasky | 430/567 |
| 5,275,930 | 1/1994 | Maskasky | 430/567 |
| 5,292,632 | 3/1994 | Maskasky | 430/567 |

FOREIGN PATENT DOCUMENTS

| | | | |
|---|---|---|---|
| 096726 | 12/1983 | European Pat. Off. | 430/567 |
| 0534395 | 3/1993 | European Pat. Off. . | |
| 58-106532 | 6/1983 | Japan . | |
| 61-75337 | 4/1986 | Japan . | |
| 4056845 | 2/1992 | Japan | 430/567 |

OTHER PUBLICATIONS

Abstract of Japanese Patent 4-56845 Feb. 1992.

*Primary Examiner*—Janet C. Baxter

*Attorney, Agent, or Firm*—Peter C. Cody

[57] ABSTRACT

Disclosed are photographic elements comprising a silver halide emulsion having incorporated therein a hollow silver halide grain, wherein the hollow silver halide grain internally contains at least two distinct voids. Also disclosed is a process for making photographic emulsions containing grains that internally contain at least two distinct voids.

21 Claims, 5 Drawing Sheets

PROCESS FOR THE PREPARATION OF SILVER HALIDE EMULSIONS AND PHOTOGRAPHIC ELEMENTS CONTAINING HOLLOW SILVER HALIDE GRAINS

FIELD OF THE INVENTION

This invention relates to photography, and more specifically to photographic elements comprising hollow silver halide grains. This invention also relates to a process for making photographic silver halide emulsions.

BACKGROUND OF THE INVENTION

Virtually all silver halide grains utilized in photography exhibit face centered cubic ("rock salt") crystal lattice structures. Face centered cubic lattice structures are those lattice structures that have an internal ion arrangement—a crystal lattice—akin to the arrangement of ions in standard table salt (NaCl). Each lattice structure, barring imperfections or impurities which could distort the ionic arrangement, has similar ion types (anion or cation) occupying the corners and center of each face of a cube.

Although presently utilized silver halide grains have cubic lattices, such lattices, as noted, define an internal structure. The external appearance of grains defined by cubic lattices may be cubic, but this is not required. Silver halide grains containing cubic lattices may also take any one of a number of other morphologies.

Known morphologies for silver halide grains are as described in, for example, Maskasky, "The Seven Different Kinds of Crystal Forms of Photographic Silver Halides" Journal of Imaging Science, Vol. 30, 1986, pp. 247–255. It should be noted that known forms include the cube, octahedron, rhombic dodecahedron trisoctahedron, icositetrahedron, tetrahexahedron, and hexoctahedron.

In addition to describing silver halide grains according to their morphology, it is common practice in the art to describe grains by reference to their crystalline faces. Typically, Miller indices are utilized to define each face which bounds a silver halide grain. Miller indices, calculations thereof, and their manner of application are described in *Crystals Perfect and Imperfect* by A. Bennet, D. Hamilton, A. Maradudin, R. Miller and J. Murphy: Walker and Company, N.Y., 1965.

For cubic grains, the six crystal faces are usually referred to as {100} crystal faces, such reference being based upon the appropriate Miller indices. While the {100} crystal face designation is most commonly employed in connection with cubic silver halide grains, these same crystal faces are sometimes referred to as {200} crystal faces, the difference in designation resulting from a difference in the definition of the basic unit of the crystal structure.

Although {100} crystal faces represent the faces of a cubic grain, such faces may also be found in more irregularly shaped grains. An example of grains having a different morphology and yet also having {100} crystalline faces are the {100} silver chloride tabular grains of U.S. Pat. Nos. 5,264,337 and 5,275,930, and published European Patent Application 0 534 395. The grains of these references are tabular rather than cubic, and their primary faces have {100} Miller indices.

In addition to cubic grains, known silver halide grains also include octahedral grains. Octahedral grains have been determined to have {111} crystal faces. Like {100} crystal faces which are not limited merely to cubic grains, {111} crystal faces can be found in a multitude of other types of grains. An example of an irregular shaped grain having {111} major crystal faces can be found in Maskasky, "An Enhanced Understanding of Silver Halide Tabular Grain Growth", Vol. 31, 1987 pp. 15–26, which discusses trapezoid shaped grains having {111} major faces.

U.S. Pat. No. 4,643,966, discloses tabular grains having a ruffled surface. The ruffling of these grains is the result of protrusions emanating from the tabular surface of a {111} base plane. The protrusions may be small three sided "pyramids", each side of the pyramid having other than a {111} crystal face.

A third type of morphology of silver halide grains, although one that is much less common than the cubic or octahedral morphologies, is the rhombic dodecahedron. The rhombic dodecahedral grain is bounded by twelve identical faces. These faces are generally referred to as {110} crystal faces. As with {100} and {111} crystal faces, {110} crystal faces may be found in irregularly shaped grains.

The remaining morphologies of silver halide grains all have distinctive crystalline face arrangements. Furthermore, each face can be defined by reference to the appropriate Miller indices which, in turn, can be confirmed by a combination of visual inspection and the determination of the angle formed by the intersection of adjacent crystalline faces. This method of confirming the Miller indices of a certain crystal face may also be utilized to confirm that a given face is a {100}, {111}, or {110} crystal face.

In addition to the grain morphologies described by Maskasky, "The Seven Different Kinds of Crystal Forms of Photographic Silver Halides" Journal of Imaging Science, Vol. 30, 1986, pp. 247–255, and discussed above, which are regular morphologies—that is, they represent the seven basic homogenous crystal forms of a cubic crystal lattice—other irregular silver halide morphologies exist, these being primarily due to a combination of regular morphologies or to imperfections contained within a regular morphology.

One such irregular morphology, discussed previously, is the tabular morphology. Tabular silver halide grains have been known for years and are described in, for example, U.S. Pat. No. 4,439,520.

Cubic silver halide grains having a depression on each face and/or a hollow portion formed by joining depressions on adjacent or opposite sides of the cube are also known. U.S. Pat. No. 4,710,455 discloses such grains which can be prepared by first precipitating monodisperse cubic silver halide crystals, and then precipitating silver halide having a lower solubility than the first silver halide crystals to dissolve the first silver halide crystals.

Published Japanese Patent application 58-106532 discloses grains similar to those grains disclosed in U.S. Pat. No. 4,710,455, except that such grains are octahedral or tetradecahedral. Recesses are formed on the middle part of each grain's {111} crystal faces.

U.S. Pat. No. 5,045,443 discloses tabular grains having opposing parallel major faces that are of the {111} crystal face type. In the central region of each major face, indentations or spaces are formed.

Published Japanese Patent application 61-75337 discloses hollow silver halide grains having connecting voids having "through" holes from the surface of each grain to its inside. Such grains are formed from a "core-shell" arrangement wherein the inner "core" is susceptable to dissolution in a solvent at a faster rate than the outer "shell" region. A halide solvent such as ammonium thiocyanate is added to the grains in order to facilitate the hollowing process.

Similarly, U.S. Pat. No. 4,419,442 discloses silver halide grains having a shell of silver halide substantially surrounding a water-soluble, non-silver containing grain core. Conversion of the grains to hollow grains can be accomplished by washing the grains in an aqueous enviroment.

Published Japanese Patent application 4-56845 discloses a silver halide emulsion containing cubic or tetradecahedral grains having {100} crystal faces. On the center of each such face are located recesses of varying depths and sizes.

In all of the above teachings, the hollow portions or depressions in grains are not entirely encapsulated. Rather, they are, in one form or another, contiguous with the grains' surrounding environment.

U.S. Pat. No. 4,916,052 discloses hollow grains and a process for their preparation. This patent describes epitaxially growing tabular grains on a silver iodide seed crystal composed of a set of four hexagonal bipyramids that are joined at their bases to form a common tetrahedron. The tabular grains grow at the seed grain's terminations and are allowed to grow until they completely encapsulate the seed grain, thus forming substantially hollow grains.

Although it is known in the art to form hollow silver halide grains or silver halide grains having indentations on their crystal faces, it has yet been shown how to form grains having multiple internal voids. Naturally, it follows that the art has also failed to describe photographic elements containing such grains.

SUMMARY OF THE INVENTION

The present invention overcomes the inadequacies of the prior art by providing a photographic element comprising a silver halide emulsion having incorporated therein a silver halide grain internally containing at least two distinct voids.

Also provided in accordance with the present invention is a process for preparing a photographic emulsion comprising hollow silver halide grains. The process comprises a) providing a dispersing medium and preformed silver halide grains having at least two {100} crystal faces, in a reaction vessel;

b) adsorbing to the surfaces of said preformed grains a silver halide {111} or {110} growth modifier; and c) precipitating or Ostwald ripening a sufficient amount of additional silver halide onto said surfaces of said preformed grains in the presence of said silver halide {111} or {110} growth modifier so as to encapsulate at least two distinct voids.

The silver halide emulsion prepared by the inventive process comprises a colloidal dispersing medium and silver halide grains which have both an internal and an external surface, the external surface contacting the colloidal medium and the internal surface encapsulating at least two distinct voids.

The invention presents to the art the opportunity to encapsulate photographically useful chemistry in silver halide grains. Such encapsulated chemistry, examples of which include image-modifying or color-forming couplers, can be selectively released during development so as to optimize the photographic characteristics of a photographic element. Also, the present invention advances the art by providing silver halide grains having greatly increased grain surface to volume ratios.

BRIEF DESCRIPTION OF THE DRAWINGS

FIG. 6 is an isometric view of a regular cubic silver halide grain.

FIG. 7 is an isometric view of a regular octahedral silver halide grain.

FIG. 8 is an isometric view of a regular rhombic dodecahedral silver halide grain.

FIG. 9 is an isometric view of a regular trisoctahedral silver halide grain.

FIG. 10 is an isometric view of a regular icositetrahedral silver halide grain.

FIG. 11 is an isometric view of a regular tetrahexahedral silver halide grain.

FIG. 12 is an isometric view of a regular hexoctahedral silver halide grain.

DETAILED DESCRIPTION OF THE INVENTION

Figure 1:
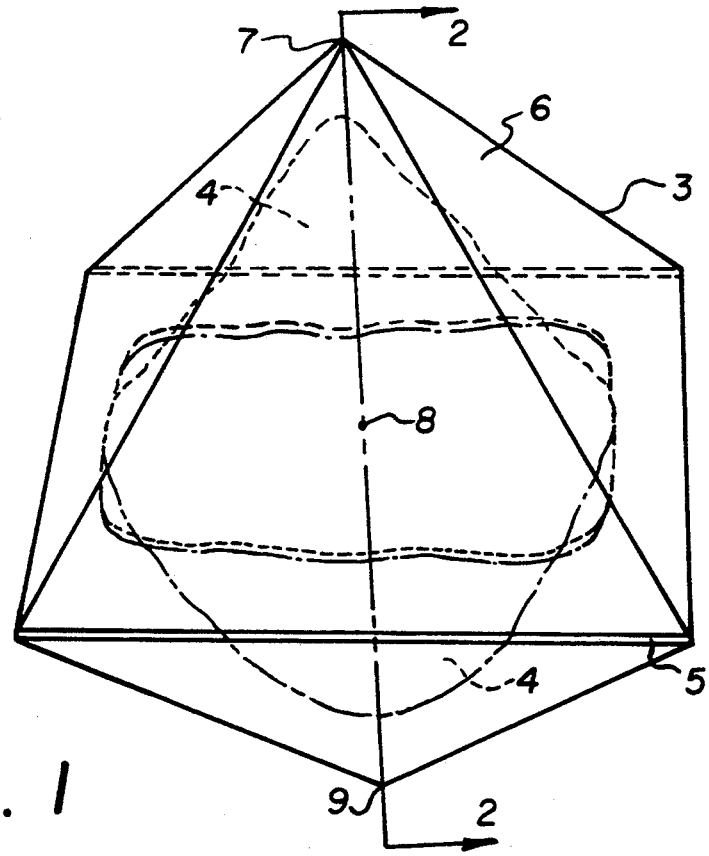
FIG. 1 is an isometric view of a grain employed in preferred embodiment of the present invention. Shown is an octahedral silver halide grain having distinct voids on opposing sides of an internal silver halide segment.

The present invention relates to photographic silver halide elements comprising novel hollow silver halide grains containing at least two distinct internal voids.

In one aspect of the invention, the novel grains have an axis of symmetry, preferably a {100} axis of symmetry, and further contain an internal segment of silver halide, the internal segment lying essentially perpendicular to the axis of symmetry. Preferably, the grains comprise two voids with the voids lying on opposing sides of the internal segment.

By "internal segment", it is meant that silver halide divides the grain into two components, with each component preferably containing a void that is distinct and separated from the void contained in the other component. Preferably, the internal segment is silver halide crystallized in an essentially tabular morphology. By "essentially tabular", it is meant that the internal segment is initially tabular having an aspect ratio greater than about two, but that during preparation of the novel grains of the invention, the tabularity of the segment may be distorted as described below. By "essentially perpendicular", it is meant that the internal segment remains essentially tabular and that the plane of original tabular segment is perpendicular to the axis of symmetry. It is likely that a summation of angles lying perpedicular to the major surfaces of distorted internal tabular segment will approximate the angle of the axis of symmetry relative to the plane of the original tabular segment.

In a preferred embodiment, silver halide is precipitated on seed tabular grains having two parallel major faces in such a manner that the precipitated silver halide is deposited primarily on the edges of the seed grain. Deposition occurs until the edge precipitate closes in upon itself, thus encapsulating voids on each side of the seed grain. Because deposition most likely does not occur in a uniform manner but rather occurs as a gradient along the seed grain's surface, the initial seed tabular grain generally will not maintain its original shape. Instead, it may become concave on each of its major parallel faces as less silver halide is deposited in the center of each surface than is deposited on the edge of each surface. Such distortion of the original seed grain may further be affected by silver halide in the seed grain being ripened onto the edges during precipitation. Though this latter distortion is less likely to occur, it may nevertheless be present.

The tabular grains utilized in the formation of the present invention's preferred hollow grains can be any of the numerous tabular grains known in the art, although it is preferred that they be of the {100} type. Examples of tabular grains having {100} major faces are described in U.S. Pat. Nos. 4,386,156 and 5,264,337, both of which are incorporated herein by reference.

Aspect ratios of such tabular grains can be as low as two but may also be as high as 15 or even higher. Preferably, the tabular grains have an aspect ratio of greater than two; more preferably, greater than five; and optimally, greater than eight. Aspect ratio is a term known in the art and can be defined as the ratio of the equivalent circular diameter to thickness, the equivalent circular diameter being the diameter of a circle having an area equal to the projected area of the grain.

Because aspect ratios in the preferred grains of the invention would be difficult to measure given the fact that the ultimately produced grains are three-dimensional, it is desired to define the preferred grains employed in the present invention by reference to the equivalent circular diameter (ECD) of their projection onto the surface on which they lie. Preferably, the grains employed in the present invention have an ECD of less than about ten microns, more preferably less than about five microns, and optimally less than about three microns.

Although the preferred seed grains are tabular, other seed grains having different morphologies are contemplated to be within the scope of the invention. One such example is a seed grain having a cubic morphology. A cubic grain has six equivalent {100} crystal faces, each of which could be precipitated or ripened upon. The hollow grains obtainable from the utilization of cubic seed grains would have six voids with each void contacting a different {100} crystal face (subject to distortion as discussed previously). Reaction conditions and precipitation components can be varied by those skilled in the art given the teachings of the instant application to achieve such desired hollow grains.

In the novel grains utilized in the present invention, cubic lattice type silver halides of any composition may be used. Moreover, the internal segment of silver halide may be of a distinctly different composition than that of the edge precipitate, or it may be the same. Preferably, though, the grains employed in the present invention are predominantly silver chloride or silver bromide. By predominantly silver chloride or silver bromide, it is meant that such grains are greater than 50 molar percent of the indicated silver halide. Preferably, the indicated silver halide accounts for greater than about 75 molar percent, and more preferably greater than about 85 molar percent. The grains may also contain iodide up to about 40 mole percent, although it is preferred that iodide content be less than about 25 mole percent. Iodide levels can vary in accordance with the amount of iodide soluble in a face centered cubic crystal lattice. For purely silver iodochloride grains, iodide content generally will not exceed about 13 mole percent; for purely silver iodobromide grains, iodide content generally will not exceed about 38 mole percent.

The grains employed in the present invention are also preferably comprised of octahedral or rhombic dodecahedral grains, both of which ideally have internal segments originally comprised of {100} predominantly silver chloride or silver bromide tabular grains. When the novel grains are octahedral in morphology, they have {111} crystal faces. By contrast, when the novel grains are rhombic dodecahedral in morphology, they have {110} crystal faces. If the grains are either octahedrons or rhombic dodecahedrons, it is preferred that they be bisected by the plane defined by the grains' internal segment.

With reference now to the Figures, FIG. 1 represents a grain employed in a preferred embodiment of the invention. Shown is an octahedral silver halide grain 3 having distinct voids 4 on opposing sides of an internal silver halide segment 5. The eight crystal faces of the octahedral grain, of which only five can be determined from the Figure, are {111} crystal faces. One such {111} face is indicated by 6. Also shown in FIGS. 1 are points 7, 8 and 9 through which an axis of symmetry lies. The axis of symmetry lies essentially perpendicular to the internal silver halide segment 5.

Figure 2:
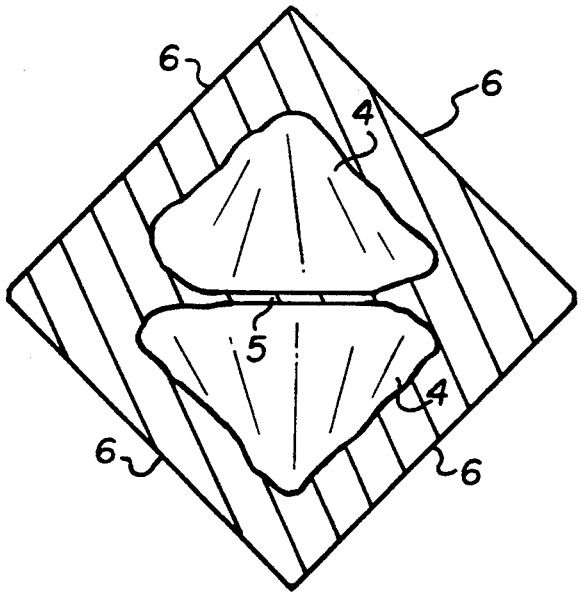
FIG. 2 is a cross-sectional view, at approximately $\times\frac{3}{4}$ scale, of the octahedral grain of FIG. 1, taken through 2.

FIG. 2 is a cross-sectional view of the octahedral grain of FIG. 1, taken through line 2. Shown are the distinct voids 4 on opposing sides of the internal silver halide segment 5. Four of the eight {111} crystal faces are indicated by 6.

Figure 3:
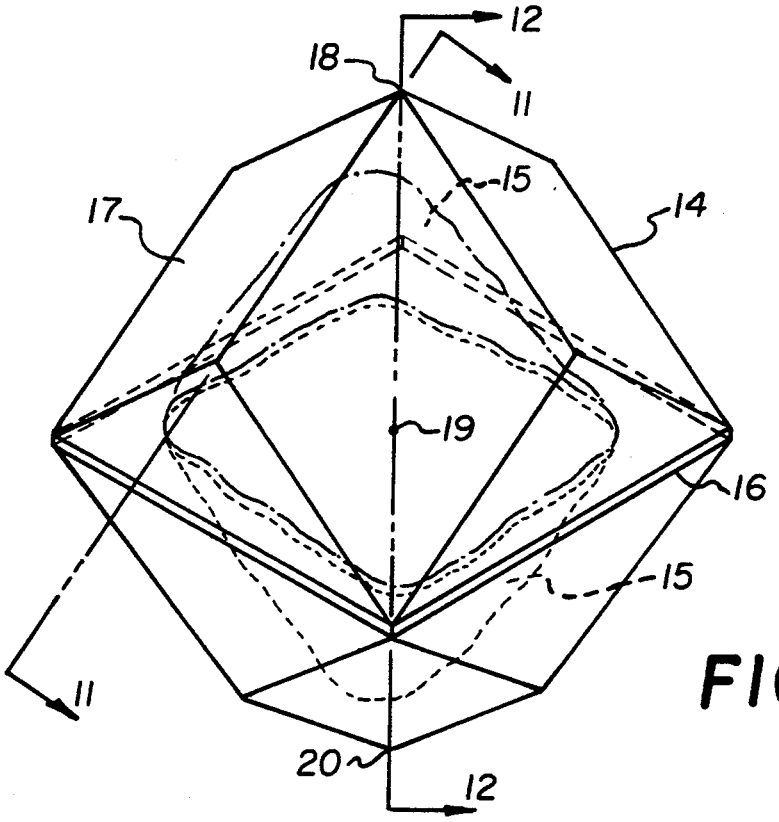
FIG. 3 is an isometric view of a grain employed in another preferred embodiment of the present invention. Shown is an rhombic dodecahedral silver halide grain having distinct voids on opposing sides of an internal silver halide segment.

FIG. 3 represents a grain employed in another preferred embodiment of the invention. Shown is an rhombic dodecahedral silver halide grain 14 having distinct voids 15 on opposing sides of an internal silver halide segment 16. The twelve crystal faces of the rhombic dodecahedral grain, of which only six can be determined from the Figure, are {110} crystal faces. One such {110} crystal face is indicated by 17. Also shown in FIG. 3 are points 17, 19 and 20 through which an axis of symmetry lies. The axis of symmetry lies essentially perpendicular to the internal silver halide segment 16.

Figure 4:
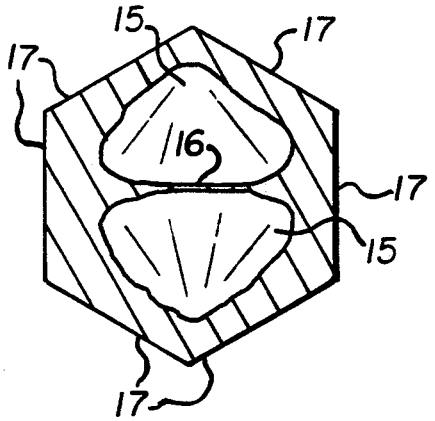
FIG. 4 is a cross-sectional view, at approximately $\times\frac{1}{2}$ scale, of the rhombic dodecahedral grain of FIG. 3, taken through 11.

FIG. 4 is a cross-sectional view of the rhombic dodecahedral grain of FIG. 3, taken through 11. Shown are the distinct voids 15 on opposing sides of the internal silver halide segment 16. Six of the twelve {110} crystal faces are indicated by 17.

Figure 5:
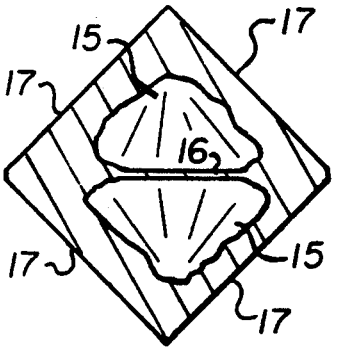
FIG. 5 is a cross-sectional view, at approximately $\times\frac{1}{2}$ scale, of the rhombic dodecahedral grain of FIG. 3, taken through 12.

FIG. 5 is a cross-sectional view of the rhombic dodecahedral grain of FIG. 3, taken through 12. Shown are the distinct voids 15 on opposing sides of the internal silver halide segment 16. Four of the twelve {110} crystal faces are indicated by 17.

Figure 6:
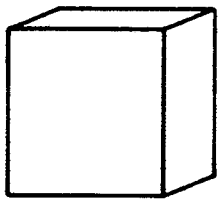
FIGS. 6 through 12 are isometric views of the seven basic homogenous crystal faces of a cubic crystal lattice.
Figure 7:
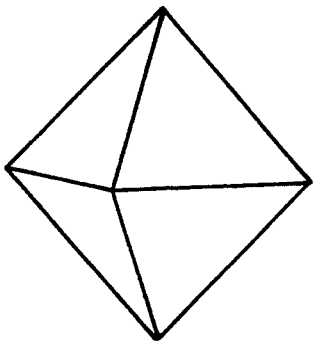
Figure 8:
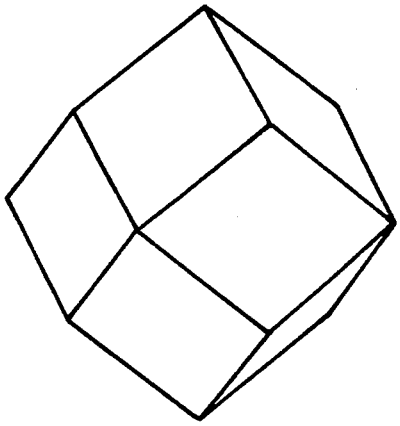
Figure 9:
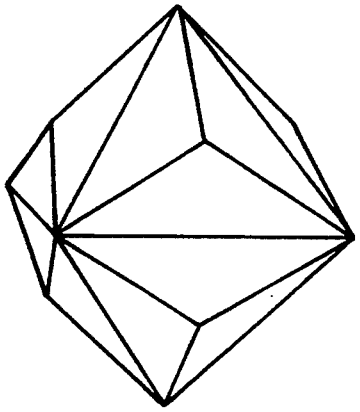
Figure 10:
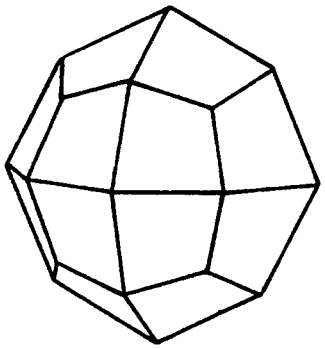
Figure 11:
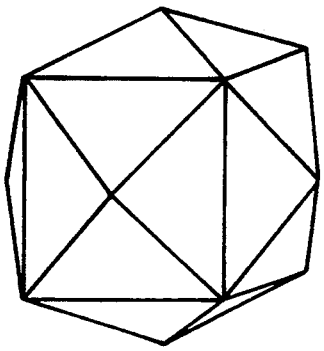
Figure 12:
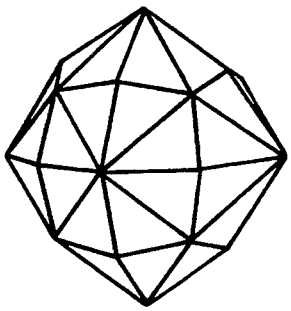

FIGS. 6 through 12 represent isometric views of the seven basic homologous crystal forms of a cubic crystal lattice. FIG. 6 is an isometric view of a regular cubic silver halide grain. FIG. 7 is an isometric view of a regular octahedral silver halide grain. FIG. 8 is an isometric view of a regular rhombic dodecahedral silver halide grain. FIG. 9 is an isometric view of a regular trisoctahedral silver halide grain. FIG. 10 is an isometric view of a regular icositetrahedral silver halide grain. FIG. 11 is an isometric view of a regular tetrahexahedral silver halide grain. FIG. 12 is an isometric view of a regular hexoctahedral silver halide grain.

Figure 13:
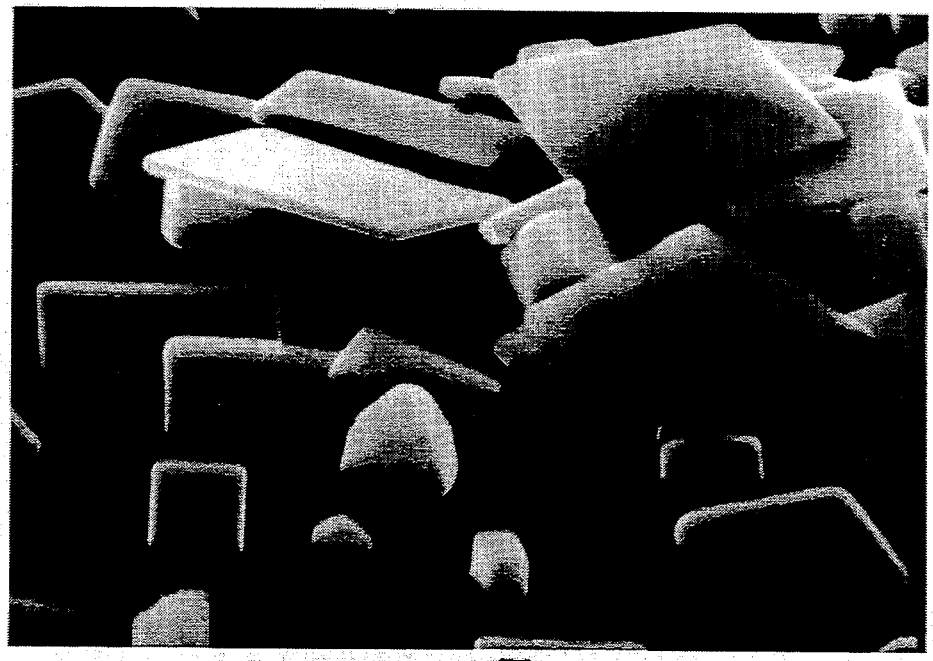
FIG. 13 is a scanning electron micrograph (×10,000) of a predominantly silver chloride {100{ tabular grain emulsion, Host Emulsion A.

FIG. 13 is a scanning electron micrograph of Host Emulsion A which serves as a seed tabular grain emulsion for the grains employed in a preferred embodiment of the present invention. The grains shown are predominantly silver chloride tabular grains. The major parallel crystal faces of these grains are {100} crystal faces.

Figure 14:
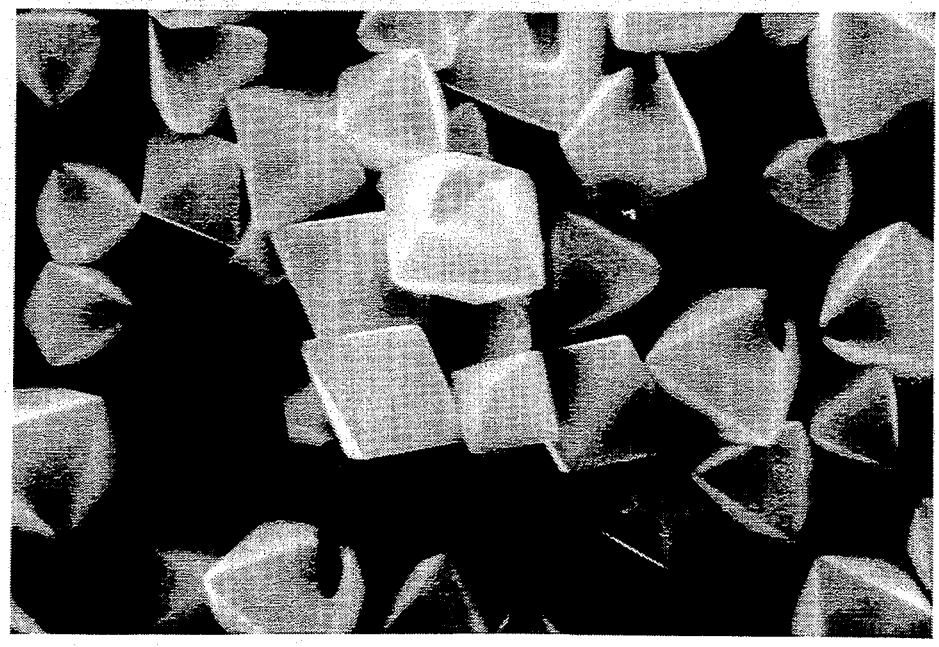
FIGS. 14 (×5,000) and 15 (×10,000) are scanning electron micrographs of grains employed in a preferred embodiment of the present invention.
Figure 15:
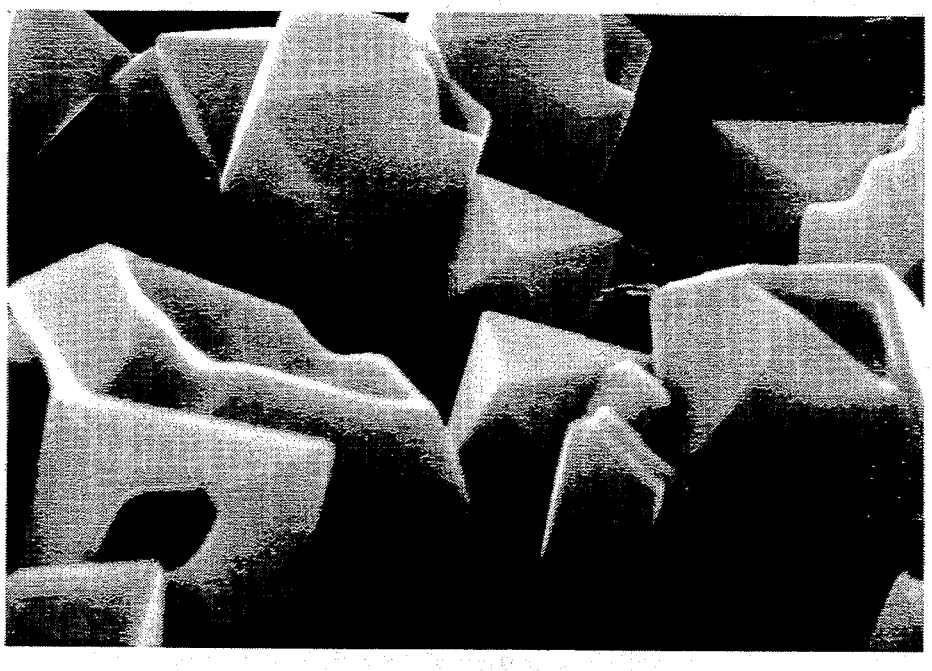

FIGS. 14 and 15 are scanning electron micrographs of grains employed in a preferred embodiment of the invention. As can be seen, these grains are octahedral in morphology, much like the grain described and shown in FIG. 1. FIG. 14 specifically shows the grains of Example 1, described below. FIG. 15 specifically shows the grains of Example 2, also described below. As is evident from these micrographs, hollow regions as represented by reduced electron density (darker) areas can be seen near two of the opposing apices while the other four apex regions—on a plane with the seed tabular grain—show no reduced electron density area.

In a preferred embodiment of the invention, the novel silver halide grains have incorporated in at least one of their voids a photographically useful compound, or a compound capable of releasing a photographically useful compound or precursor thereof. By photographically useful compound it is meant any compound capable of exerting a photographic effect. Photographically useful compounds include chemical sensitizers, spectral sensitizing dyes, x-ray excitable phosphors, brighteners, antifoggants, stabilizers, desensitizers, color forming couplers, development inhibitors, development accelerators, developing agents, silver halide solvents, toners, hardeners, fogging agents, masking couplers, and any of those compounds described below and known in the art to impart a photographic effect on a photographic element.

Incorporation of photographically useful compounds, or compounds capable of forming a photographically useful compound or its precursor, into the voids of the novel hollow grains could readily be done by stopping precipitation prior to closure of the voids, adding the desired compound to the emulsion, and then resuming precipitation. The desired compound would be incorporated both internally and externally onto the grains, but could be externally removed by washing the final emulsion, thus leaving grains internally encapsulating a photographically useful compound or compound capable of forming a photographically useful compound or its precursor. The washing process could include washing at a low pH (e.g. 3.5 as decribed in U.S. Pat. No. 5,221,602) or in the presence of an oxidizing agent or compound capable of reacting with surface absorbed photographically useful compounds.

The present invention may be practiced in black-and-white, reversal or color negative photographic elements utilizing any other type of silver halide grains. These other grains may be conventional in form such as cubic, octahedral, or cubooctahedral, or they may be irregular such as spherical grains or tabular grains. The other grains may be present in the emulsion containing the invention's novel grains or they may be present in adjacent or other emulsion layers within photographic element.

The photographic elements of the present invention may be simple single layer elements or multilayer, multicolor elements. Multicolor elements contain dye image-forming units sensitive to each of the three primary regions of the visible light spectrum. Each unit can be comprised of a single emulsion layer or of multiple emulsion layers sensitive to a given region of the spectrum. The layers of the element, including the layers of the image-forming units, can be arranged in various orders as known in the art.

A typical multicolor photographic element comprises a support bearing a cyan dye image-forming unit comprising at least one red-sensitive silver halide emulsion layer having associated therewith at least one cyan dye-forming coupler; a magenta image-forming unit comprising at least one green-sensitive silver halide emulsion layer having associated therewith at least one magenta dye-forming couple; and a yellow dye image-forming unit comprising at least one blue-sensitive silver halide emulsion layer having associated therewith at least one yellow dye-forming coupler. The element may contain additional layers, such as filter layers, interlayers, overcoat layers, subbing layers, and the like.

The photographic elements may also contain a transparent magnetic recording layer such as a layer containing magnetic particles on the underside of a transparent support, as in U.S. Pat. Nos. 4,279,945 and 4,302,523. Typically, the element will have a total thickness (excluding the support) of from about 5 to about 30 microns. It is also contemplated, though, that the novel grains utilized in accordance with the invention will allow single layer three color photographic elements to be constructed, the single layer having at least three types of hollow silver halide grains, each type containing a different color-forming coupler. Such single layer three color elements could be constructed with a thickness of less than 5 microns.

In the following discussion of suitable materials for use in the elements of this invention, reference will be made to *Research Disclosure*, December 1978, Item 17643, and *Research Disclosure*, December 1989, Item No. 308119, both published by Kenneth Mason Publications, Ltd., Dudley Annex, 12a North Street, Emsworth, Hampshire PO10 7DQ, ENGLAND, the disclosures of which are incorporated herein by reference. These publications will be identified hereafter by the term "Research Disclosure." A reference to a particular section in "Research Disclosure" corresponds to the appropriate section in each of the above-identified *Research Disclosures*. The elements of the invention can comprise emulsions and addenda described in these publications and publications referenced in these publications.

As noted above, the silver halide emulsions employed in the elements of this invention can also include other silver halide grains. Such grains can be comprised of silver bromide, silver chloride, silver iodide, silver bromochloride, silver iodochloride, silver iodobromide, silver iodobromochloride or mixtures thereof. The emulsions can include silver halide grains of any conventional shape or size. Specifically, the emulsions can include coarse, medium or fine silver halide grains. High aspect ratio tabular grain emulsions are specifically contemplated, such as those disclosed by Wilgus et al. U. S. Pat. No. 4,434,226, Daubendiek et al. U.S. Pat. No. 4,414,310, Wey U.S. Pat. No. 4,399,215, Solberg et al. U.S. Pat. No. 4,433,048, Mignot U.S. Pat. No. 4,386,156, Evans et al. U.S. Pat. No. 4,504,570, Maskasky U.S. Pat. No. 4,400,463, Wey et al. U.S. Pat. No. 4,414,306, Maskasky U.S. Pat. Nos. 4,435,501 and 4,643,966 and Daubendiek et al. U.S. Pat. Nos. 4,672,027 and 4,693,964, all of which are incorporated herein by reference. Also specifically contemplated are those silver iodobromide grains with a higher molar proportion of iodide in the core of the grain than in the periphery of the grain, such as those described in British Reference No. 1,027,146; Japanese Reference No. 54/48,521; U.S. Pat. Nos. 4,379,837; 4,444,877; 4,665,012; 4,686,178; 4,565,778; 4,728,602; 4,668,614 and 4,636,461; and in European Reference No. 264,954, all of which are incorporated herein by reference.

The silver halide emulsions can be either monodisperse or polydisperse as precipitated. The grain size distribution of the emulsions can be controlled by silver halide grain separation techniques or by blending silver halide emulsions of differing grain sizes.

Dopants, such as compounds of copper, thallium, lead, bismuth, cadmium and Group VIII noble metals, can be present during precipitation of any of the grains of the silver halide emulsion. Other dopants include transition metal complexes as described in U.S. Pat. Nos. 4,981,781, 4,937,180, and 4,933,272.

The emulsions can be surface-sensitive emulsions, i.e., emulsions that form latent images primarily on the surface of the silver halide grains; or internal latent image-forming emulsions, i.e., emulsions that form latent images predominantly in the interior of the silver halide grains. The emulsions can be negative-working emulsions such as surface-sensitive emulsions or unfogged internal latent image-forming emulsions, but can also be direct-positive emulsions of the unfogged, internal latent image-forming type, which are positive-working when development is conducted with uniform light exposure or in the presence of a nucleating agent.

The silver halide emulsions can further be surface-sensitized, and noble metal (e.g., gold), middle chalcogen (e.g., sulfur, selenium, or tellurium) and reduction sensitizers, employed individually or in combination, are specifically contemplated. Typical chemical sensitizers are listed in *Research Disclosure*, Item 308119, cited above, Section III.

The silver halide emulsions can be spectrally sensitized with dyes from a variety of classes, including the polymethine dye class, which includes the cyanines, merocyanines, complex cyanines and merocyanines (i.e., tri-tetra-, and polynuclear cyanines and merocyanines), oxonols, hemioxonols, stryryls, merostyryls, and streptocyanines. Illustrative spectral sensitizing dyes are disclosed in *Research Disclosure*,. Item 308119, cited above, Section IV.

Suitable vehicles for the emulsion layer and other layers of elements of this invention are described in *Research Disclosure*, Item 308119, Section IX and the publications cited therein.

The elements of this invention can include couplers as described in *Research Disclosure*, Section VII, paragraphs D, E, F, and G and the publications cited therein. The couplers can be incorporated as described in *Research Disclosure*, Section VII, paragraph C, and the publications cited t-herein. Also contemplated are elements which further include image modifying couplers as described in *Research Disclosure*, Item 308119, Section VII, paragraph F.

The photographic elements of this invention can contain brighteners (*Research Disclosure*, Section V), antifoggants and stabilizers such as mercaptoazoles (for example, 1-(3-ureidophenyl)-5-mercaptotetrazole), azolium salts (for example, 3-methylbenzothiazolium tetrafluoroborate), thiosulfonate salts (for example, p-toluene thiosulfonate potassium salt), tetraazaindenes (for example, 4-hydroxy-6-methyl-1,3,3a,7-tetraazaindene), and those described in *Research Disclosure*, Section VI, antistain agents and image dye stabilizers (*Research Disclosure*, Section VII, paragraphs I and J), light absorbing and scattering materials (*Research Disclosure*, Section VIII), hardeners (*Research Disclosure*, Section X), polyalkyleneoxide and other surfactants as described in U.S. Pat. No. 5,236,817, coating aids (*Research Disclosure*, Section XI), plasticizers and lubricants (*Research Disclosure*, Section XII), antistatic agents (*Research Disclosure*, Section XIII), matting agents (*Research Disclosure*, Section XII and XVI) and development modifiers (*Research Disclosure*, Section XXI.

The photographic elements can be coated on a variety of supports as described in *Research Disclosure*, Section XVII and the references described therein.

The photographic elements of the invention can be exposed with various forms of energy which encompass the ultraviolet, visible, and infrared regions of the electromagnetic spectrum as well as with electron beam, beta radiation, gamma radiation, x-ray, alpha particle, neutron radiation, and other forms of corpuscular and wave-like radiant energy in either noncoherent (random phase) forms or coherent (in phase) forms, as produced by lasers. When the photographic elements are intended to be exposed by x-rays, they can include features found in conventional radiographic elements, such as those disclosed in *Research Disclosure*, Vol. 184, August 1979, Item 18431 which is incorporated herein by reference.

The photographic elements of the invention are preferably exposed to actinic radiation, typically in the visible region of the spectrum, to form a latent image as described in *Research Disclosure*, Section XVIII, and then processed to form a visible dye image as described in *Research Disclosure*, Section XIX. Processing to form a visible dye image includes the step of contacting the element with a color developing agent to reduce developable silver halide and oxidize the color developing agent. Oxidized color developing agent in turn reacts with the coupler to yield a dye.

Preferred color developing agents are p-phenylenediamines. Especially preferred are 4-amino-3-methyl-N,N-diethylaniline hydrochloride, 4-amino-3-methyl-N-ethyl-N-(β-methanesulfonamidoethyl)-aniline sulfate hydrate, 4-amino-3-methyl-N-ethyl-N-(β-hydroxyethyl)-aniline sulfate, 4-amino-3-(β-methanesulfonamidoethyl)-N,N-diethylaniline hydrochloride, and 4-amino-N-ethyl-N-(β-methoxyethyl)-m-tolyidine di-p-toluenesulfonic acid.

With negative-working silver halide emulsions, the processing step described above provides a negative image. The described elements can be processed in the known C-41 color process as described in, for example, the British Journal of Photography Annual, 1988, pages 196–198. To provide a positive (or reversal) image, the color development step can be preceded by development with a non-chromogenic developing agent to develop exposed silver halide, but not form dye, and then uniformly fogging the element to render unexposed silver halide developable. Reversal processing of the element of the invention is preferably done in accordance with the known E6 process as described and referenced in *Research Disclosure* paragraph XIX. Alternatively, a direct positive emulsion can be employed to obtain a positive image.

Development is followed by the conventional steps of bleaching, fixing, or bleach-fixing, to remove silver or silver halide, washing, and drying.

The present invention also relates to a process of making photographic emulsions comprising hollow silver halide grains internally containing at least two distinct voids. Specifically, the process comprises the following steps: providing a dispersing medium and preformed silver halide grains (preferably tabular) that have at least two {100} crystal faces, in a reaction vessel; adsorbing to the surfaces of said preformed grains a silver halide {111} or {110} growth modifier; and precipitating or Ostwald ripening a sufficient amount of additional silver halide onto said surfaces of said preformed grains in the presence of said silver halide {111} or {110} growth modifier so as to encapsulate at least two distinct voids. Although the amount of additional silver halide required to complete encapsulation will vary in accordance with the particular components and process conditions, it is contemplated that the amount be sufficient to allow for complete encapsulation in at least 25 percent of the grains in the emulsion. Preferably, the amount will allow for complete encapsulation in at least 50 percent, and more preferably in at least 90 percent, of the grains of the emulsion.

In preparing emulsions in accordance with the above procedures, it is contemplated that precipitation or ripening occur until exhaustion of excess silver halide has occurred; that is, until all the silver halide in the emulsion is present in hollow or substantially hollow grains. Precipitation can be by any method known in the art, for instance, single or double jet precipitation.

In the preferred embodiment of the invention, the preformed {100} tabular grains are predominantly silver chloride or silver bromide, the growth modifiers are those that cause the formation of {111} or {110} faces on the the predominantly silver chloride or silver bromide {100} tabular grains, and the additionally precipitated or ripened silver halide is predominantly silver chloride or silver bromide. It is desired, but not required, that the tabular grains be of similar halide composition as that of the additional precipitate, and it follows that the growth modifier be such as to allow the precipitation or ripening to occur. In other words, if the desired grains are to be predominantly silver chloride octahedral grains, that is predominantly silver chloride grains having eight {111} crystal faces, the growth modifier should be a silver chloride {111} growth modifier and the additional silver halide should be predominantly silver chloride. Conversely, if the desired grains are to be predominantly silver bromide rhombic dodecahedral grains, that is predominantly silver bromide grains having twelve {110} crystal faces, the growth modifier should be a silver bromide {110} growth modifier and the additional silver halide should be predominantly silver bromide.

Growth modifiers as used herein and as typically referred to in the art are those compounds that allow for the formation of specific types of crystal faces. Growth modifiers effect the specific manner in which additional silver halide is precipitated or ripened onto a seed grain. In essence, they adsorb to a particular type of crystal face and prevent the continued growth of that type of crystal face while allowing for the continued growth of other types of crystal faces.

The amount of growth modifier required to control growth of the grain population is a function of the total grain surface. Thus, the benefits of the invention can be realized using any amount of growth modifier that is effective to retard growth of {111} or {110} faces of the preformed grains.

It is generally contemplated to have present in the emulsion during growth sufficient growth modifier to provide a monomolecular adsorbed layer over at least 25 percent, preferably at least 50 percent, of the total grain surface area of the emulsion grains. Higher amounts of adsorbed growth modifier are, of course, feasible. Adsorbed growth modifier coverages of 80 percent of the monomolecular layer coverage or even 100 percent coverage are contemplated. Excess growth modifier is also contemplated as any growth modifier that remains unadsorbed is normally depleted in post-precipitation emulsion washing.

The growth modifiers can be added initially to the preformed tabular emulsion grains at the start of precipitation or can be incrementally added as the surface area of the emulsion increases. They are preferably adsorbed to the surfaces of the preformed grains under reaction conditions in which pH, pAg, temperature range from 1.5° to 8.0°, 5.0° to 10.0°, and 15° to 95° C., respectively. In the preferred processes of the invention, pH ranges from 3.5 to 7.0, pAg ranges from 6.0 to 9.5, and temperature ranges from 35° to 80° C. It is contemplated that pH can be higher than 8.0 if the invention were practiced in the presence of ammonia.

Grain growth modifiers suitable for the present invention are those known in the art to be strong growth modifiers. Examples of silver chloride {111} growth modifiers suitable for use in the present invention include those selected from the group consisting of a 4,6-di(hydroamino)-5-aminopyrimidine compound, 4-aminopyrazolo[3,4-d]pyrimidine, a xanthine or 8-azaxanthine compound, 6-hydroaminopurine, and a 7-azaindole. Other examples can be found in U.S. Pat. Nos. 5,183,732, 5,176,992, 5,217,858, 5,185,239, and 5,178,997, all of which are incorporated herein by reference.

Examples of silver bromide {111} growth modifiers suitable for use in this invention are disclosed in copending U.S. patent application Ser. No. 195,807 filed Feb. 14, 1994, the disclosure of which is incorporated herein by reference.

Examples of silver bromide {110} growth modifiers suitable for use in the present invention include those selected from the group consisting 2-mercaptopyridine, 1-phenyl-5-mercaptotetrazole, 5-imino-3-thiourazole, 2-mercapto-1,3-benzoxazole, and 2-mercapto-1-phenylbenzimidazole. Other examples can be found in Maskasky, "The Seven Different Kinds of Crystal Forms of Photographic Silver Halides" Journal of Imaging Science, Vol. 30, 1986, pp. 247–255; Maskasky, "A comparison of Some Properties of AgBr Rhombic Dodecahedra with and without Adsorbed Growth Modifier", The Society for Imaging Science and Technology, Vol.

32, 1988, pp 95–99; and U.S. Pat. No. 3,817,756, all of which are incorporated herein by reference.

To practice a preferred process of the invention, predominantly silver chloride {100} tabular grains formed by methods known in the art, for instance those methods described in copending U.S. Pat. Nos. 5,264,337 and 5,275,930, and published European Patent Application 0 534 395, are precipitated or ripened upon by additional silver chloride in the presence of a silver chloride {111} growth modifier. The resulting octahedral silver chloride grains comprise an internal segment and have two distinct voids on opposing sides of the internal segment. Preferred parameters for the construction of such grains are as described above with reference to the adsorbtion of growth modifier onto the preformed tabular grains. In addition, it is desired that the dispersing medium comprise gelatin and that gelatin levels be between 0.1 percent and 10 percent by weight. The specifically preferred grain growth modifiers are 4,5,6-triaminopyrimidine and 4-aminopyrazolo[3,4-d]pyrimidine.

The invention can be better appreciated by reference to the following specific examples. They are intended to be illustrative and not exhaustive of the elements of the present invention and the methods of formation of grains employed in such elements.

EXAMPLES

A Host Emulsion A was prepared in accordance with the procedures delineated in European Patent Application 0 534 395. The resultant predominantly silver chloride tabular grains had two parallel major {100} crystal faces. Further, they had a mean equivalent circular diameter of 2.5 microns and a thickness of 0.16 microns. Host emulsion A is represented in FIG. 13.

Example 1

To a stirred reaction vessel containing 0.04 mole of Host Emulsion A in 400 mL of a solution at pH 6.0 and at 60° C. that was 2 percent in bone gelatin, 2.0 mM 4,5,6-triaminopyrimidine, 0.040M NaCl and 0.20M sodium acetate were added 100 mL of 4M $AgNO_3$ at 1.0 mL/min and 4.5M NaCl solution at a rate needed to maintain a constant pCl of 1.42. The pH was maintained at 6.0. The resulting emulsion was examined by scanning electron microscopy (FIG. 14) and by optical transmission microscopy. It consisted of octahedral grains having a mean edge length of 3.2 microns. Some of the octahedral grains had holes leading to voids in two opposing apices, and most of the remaining octahedral grains had completely enclosed voids. With scanning electron microscopy, voids were shown as reduced secondary electron intensity in the apex region near two of the opposing apices while the other four apex regions did not show this reduced intensity. The voids were clearly seen by transmission optical microscopy. Nearly all of the emulsion grains (>80 percent) contained either enclosed or partially enclosed voids. Continued growth would have closed the remaining voids.

Example 2

A 400 mL solution which was 2 percent bone gelatin, 1.9 mM dissolved 4-aminopyrazolo[3,4-]pyrimidine, 0.05M NaCl, 0.20M sodium acetate and 0.04 mole of Host Emulsion A was adjusted to pH 4.4 at 60° C. To this mixture at 60° C. were added simultaneously, with stirring, 100 mL of 4M $AgNO_3$ solution at 1.0 ml/min and 4.5M NaCl solution at a rate needed to maintain a constant pCl of 1.3. The pH was maintained at 4.4. The resulting emulsion was examined by scanning electron microscopy (FIG. 15). It consisted of octahedral grains having either two enclosed voids or two partially enclosed voids.

The invention has been described in detail with particular reference to preferred embodiments thereof, but it will be understood that variations and modifications can be effected within the spirit and scope of the invention.

What is claimed:

1. A photographic element comprising a silver halide emulsion having incorporated therein a hollow silver halide grain, wherein said hollow silver halide grain encapsulates at least two distinct voids.

2. A photographic element according to claim 1 wherein said hollow silver halide grain has an axis of symmetry and further contains an internal segment of silver halide, said internal segment lying essentially perpendicular to said axis of symmetry.

3. A photographic element according to claim 2 wherein the voids lie on opposing sides of said internal segment.

4. A photographic element according to claim 3 wherein said internal segment is essentially tabular and lies essentially perpendicular to a {100} axis of symmetry.

5. A photographic element according to claim 4 wherein said hollow silver halide grain is an octahedral grain having {111} faces.

6. A photographic element according to claim 5 wherein said grains are predominantly silver chloride.

7. A photographic element according to claim 6 wherein said internal segment defines a plane bisecting said octahedral grain, said octahedral grain being further defined in that it has an equivalent circular diameter of less than about 10 microns.

8. A photographic element according to claim 7 wherein said octahedral grain has an equivalent circular diameter of less than about 5 microns.

9. A photographic element according to claim 8 wherein said octahedral grain has an equivalent circular diameter of less than about 3 microns.

10. A photographic element according to claim 5 wherein said grains are predominantly silver bromide.

11. A photographic element according to claim 5 wherein said internal segment has a different halide composition than said {111} faces.

12. A photographic element according to claim 4 wherein said hollow silver halide grain is a rhombic dodecahedral grain having {110} faces.

13. A photographic element according to claim 1 wherein said hollow silver halide grain has a photographically useful compound, or a compound capable of releasing a photographically useful compound or precursor thereof, incorporated within at least one of said distinct voids.

14. A photographic element according to claim 13 wherein the photographically useful compound is selected from the group consisting of chemical sensitizers, spectral sensitizing dyes, x-ray excitable phosphors, brighteners, antifoggants, stabilizers, desensitizers, color forming couplers, development inhibitors, development accelerators, bleach accelerators, developing agent, silver halide solvents, toners, hardeners, fogging agent, and masking couplers.

15. A process of preparing a photographic emulsion comprising hollow silver halide grains internally containing at least two distinct voids, comprising:

a) providing a dispersing medium and preformed silver halide grains having at least two {100} crystal faces, in a reaction vessel;

b) adsorbing to the surfaces of said preformed grains a silver halide {111} or {110} growth modifier; and c) precipitating or Ostwald ripening a sufficient amount of additional silver halide onto said surfaces of said preformed grains in the presence of said silver halide {111} or {110} growth modifier so as to encapsulate at least two distinct voids.

16. A process according to claim 15 wherein the preformed silver halide grains are {100} silver halide tabular grains.

17. A process according to claim 16 wherein said growth modifier is a silver chloride {111} growth modifier selected from the group consisting of a 4,6-di(hydroamino)-5-aminopyrimidine compound, 4-aminopyrazolo[3,4-d]pyrimidine, a xanthine or 8-azaxanthine compound, 6-hydroaminopurine, and a 7-azaindole.

18. A process according to claim 17 wherein the preformed {100} silver halide tabular grains are preformed {100} predominantly silver chloride tabular grains.

19. A process according to claim 16 wherein said growth modifier is a silver bromide {110} growth modifier selected from the group consisting of 2-Mercaptopyridine, 1-phenyl-5-mercaptotetrazole, 5-Imino-3-thiourazole, 2-mercapto-1,3-benzoxazole, and 2-Mercapto-1-phenylbenzimidazole.

20. A process according to claim 19 wherein the preformed {100} silver halide tabular grains are preformed {100} predominantly silver chloride tabular grains.

21. A photographic element having at least one silver halide emulsion layer comprising a colloidal dispersing medium and a silver halide grain, said grain having both an external surface and an internal surface, the external surface being in contact with said colloidal dispersing medium and the internal surface encapsulating at least two separate voids.

* * * * *